US011225925B2

(12) United States Patent
Inaba

(10) Patent No.: US 11,225,925 B2
(45) Date of Patent: Jan. 18, 2022

(54) INJECTION CONTROL DEVICE

(71) Applicant: DENSO CORPORATION, Kariya (JP)

(72) Inventor: Masashi Inaba, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/104,120

(22) Filed: Nov. 25, 2020

(65) Prior Publication Data

US 2021/0164412 A1 Jun. 3, 2021

(30) Foreign Application Priority Data

Nov. 28, 2019 (JP) ..... JP2019-215372

(51) Int. Cl.
*F02D 41/20* (2006.01)
*F02D 41/40* (2006.01)

(52) U.S. Cl.
CPC ..... *F02D 41/20* (2013.01); *F02D 41/401* (2013.01); *F02D 2041/2013* (2013.01); *F02D 2041/2031* (2013.01); *F02D 2041/2034* (2013.01); *F02D 2041/2048* (2013.01); *F02D 2041/2058* (2013.01); *F02D 2041/2068* (2013.01)

(58) Field of Classification Search
CPC .. F02D 41/20; F02D 41/401; F02D 2041/201; F02D 2041/2003–2013; F02D 2041/2031; F02D 2041/2034; F02D 2041/2048; F02D 2041/2058; F02D 2041/2068
See application file for complete search history.

(56) References Cited

U.S. PATENT DOCUMENTS 7,224,565 B2 * 5/2007 Faggioli ..... F02D 41/20 361/139
2017/0191437 A1 * 7/2017 Yanoto ..... F02D 41/20
2018/0156148 A1 * 6/2018 Nishimura ..... F02D 41/30

FOREIGN PATENT DOCUMENTS

JP 2000310145 A 11/2000

* cited by examiner

*Primary Examiner* — Hung Q Nguyen
*Assistant Examiner* — Mark L. Greene
(74) *Attorney, Agent, or Firm* — Posz Law Group, PLC

(57) ABSTRACT

An injection control device controls the opening and closing of a fuel injection valve by performing peak current drive and constant current drive with respect to the fuel injection valve and controls injection of fuel from the fuel injection valve to an internal combustion engine. The injection control device includes an energization control unit that performs constant current switching control of an energization current to the fuel injection valve. The energization control unit is configured to, when the energization current to the fuel injection valve is to be stopped, controls an energization stop timing of the energization current such that a flyback period is equal to a first predetermined time period.

14 Claims, 9 Drawing Sheets

INJECTION CONTROL DEVICE

CROSS REFERENCE TO RELATED APPLICATION

The present application claims the benefit of priority from Japanese Patent Application No. 2019-215372 filed on Nov. 28, 2019. The entire disclosure of the above application is incorporated herein by reference.

TECHNICAL HELD

The present invention relates to an injection control device.

BACKGROUND

An injection control device controls the opening and closing of a fuel injection valve by performing peak current drive and constant current drive with respect to the fuel injection valve, and controls the injection of fuel from the fuel injection valve to an internal combustion engine.

SUMMARY

In one aspect of the present disclosure, an injection control device controls the opening and closing of a fuel injection valve by performing peak current drive and constant current drive with respect to the fuel injection valve and controls injection of fuel from the fuel injection valve to an internal combustion engine. The injection control device includes an energization control unit that performs constant current switching control of an energization current to the fuel injection valve. The energization control unit is configured to, when the energization current to the fuel injection valve is to be stopped, controls an energization stop timing of the energization current such that a flyback period is equal to a first predetermined time period.

DETAILED DESCRIPTION

Figure 1:
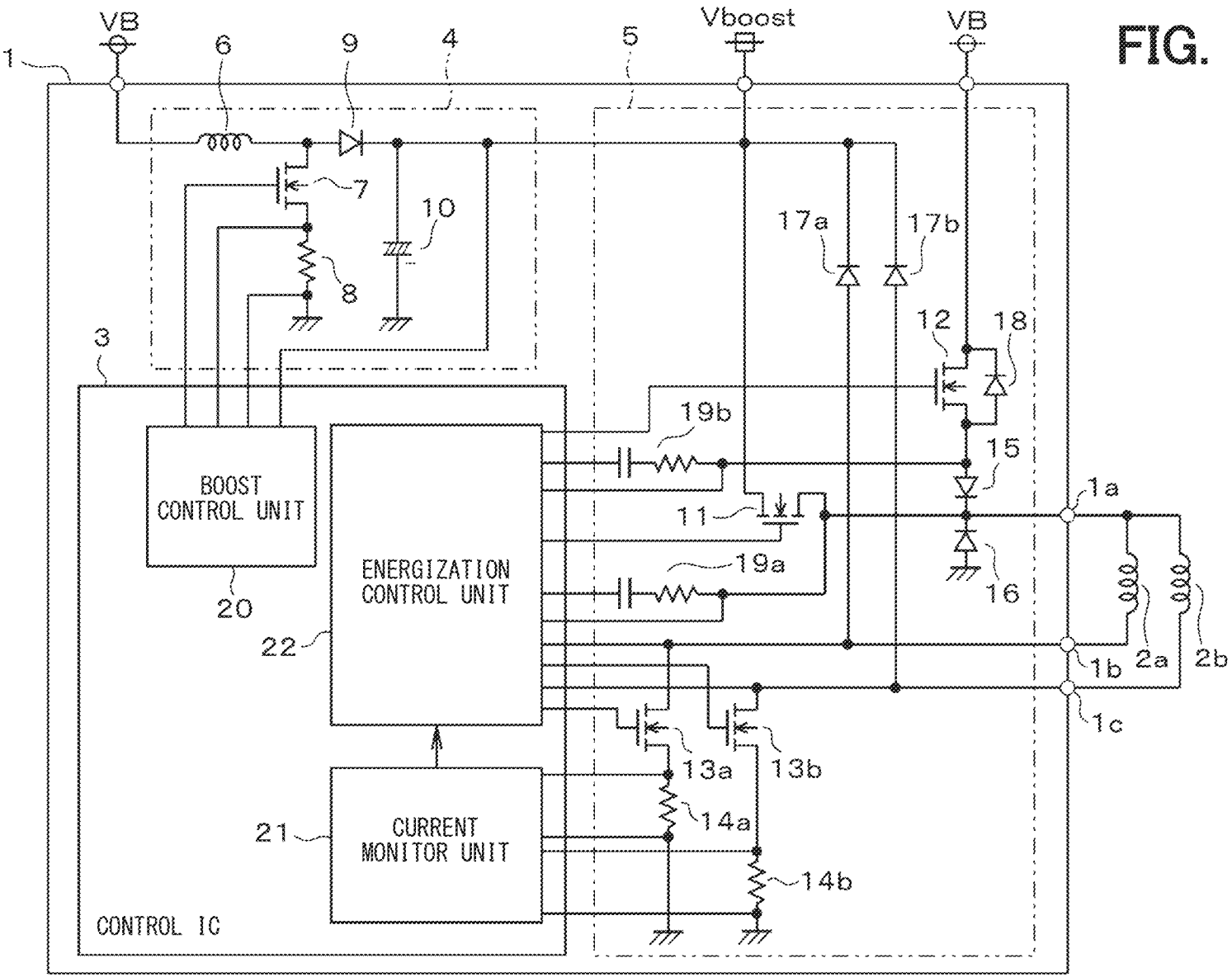
FIG. 1 is a functional block diagram.

Hereinafter, embodiments of the present disclosure will be described with reference to drawings. In the embodiments, elements corresponding to those which have been described in the preceding embodiments are denoted by the same reference numerals, and redundant description may be omitted.

First Embodiment

Figure 2:
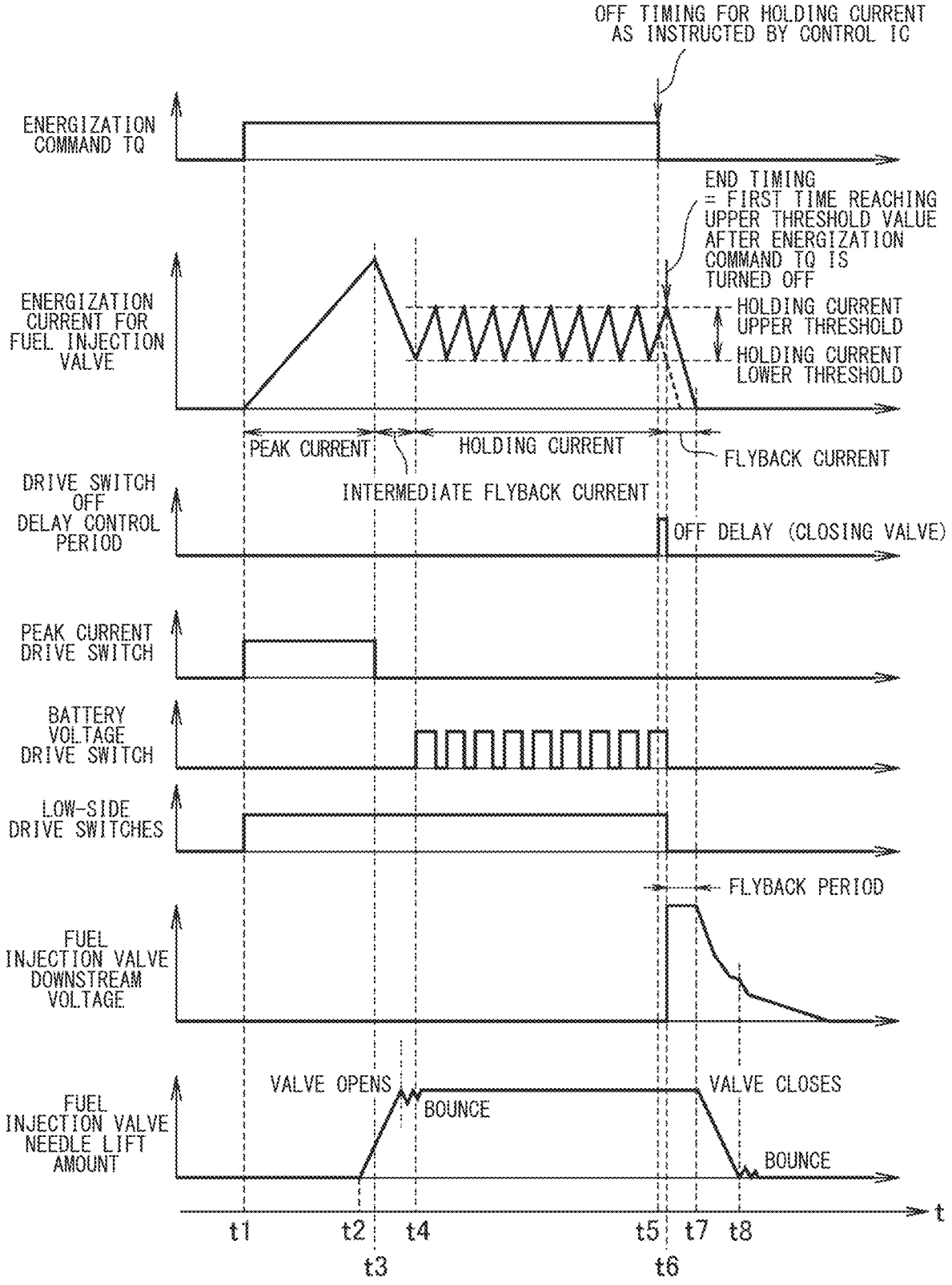
FIG. 2 is a timing chart.
Figure 3:
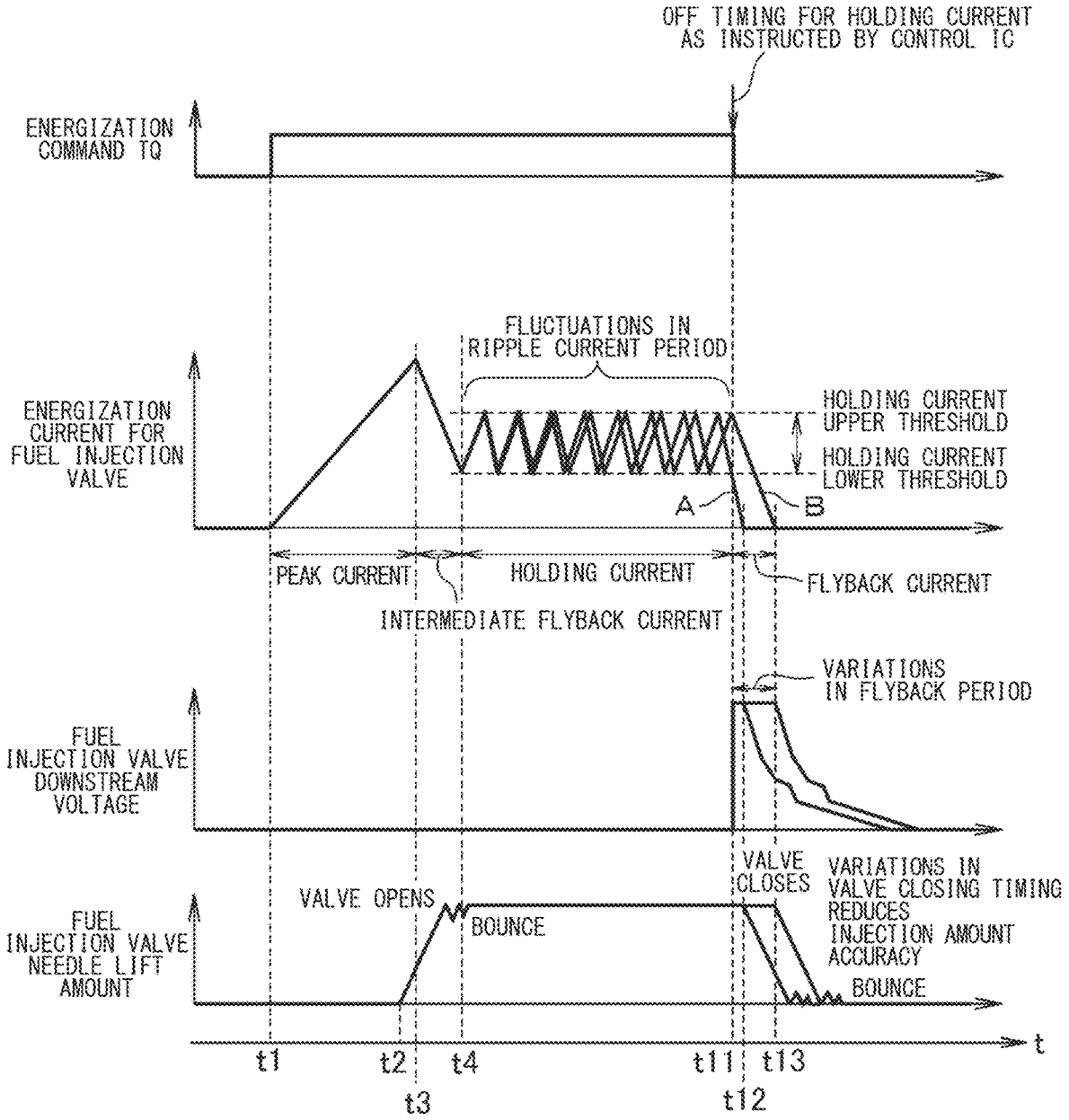
FIG. 3 is a timing chart of a comparative example.

The first embodiment will be described with reference to FIGS. 1 to 3. As shown in FIG. 1, an injection control device 1 is a device that controls the driving of solenoid-type fuel injection valves 2*a*, 2*b*. The fuel injection valves 2*a*, 2*b* are configured to inject fuel into an internal combustion engine mounted on a vehicle such as an automobile. The injection control device 1 is implemented as an electronic control unit (ECU). The fuel injection valve 2*a* is connected between an output terminal 1*a* on the upstream side and an output terminal 1*b* on the downstream side. The fuel injection valve 2*b* is connected between the output terminal 1*a* on the upstream side and an output terminal 1*c* on the downstream side. In the present embodiment, the illustrated configuration shows two fuel injection valves 2*a*, 2*b* corresponding to two cylinders, but any number of cylinders may be used. For example, the present disclosure may be applied to four cylinders or six cylinders.

The injection control device 1 includes a control IC 3, a boost circuit 4, and a drive circuit 5. The control IC 3 may be, for example, an integrated circuit device using an ASIC. The control IC 3 is configured to perform various control processes based on hardware and software. The control IC 3 includes, for example, a control unit such as a CPU or a logic circuit, a storage unit such as a RAM, a ROM, or an EEPROM, and comparators. When a sensor signal is input from an external sensor (not shown), the control IC 3 calculates an injection command timing and drives the drive circuit 5 at the calculated injection command timing. When driven, the drive circuit 5 controls the opening and closing of the fuel injection valves 2*a*, 2*b* by performing peak current drive and constant current drive with respect to the fuel injection valves 2*a*, 2*b*. As a result, the fuel injection valves 2*a*, 2*b* are controlled to inject fuel into the internal combustion engine.

The boost circuit 4 is a DC-DC converter. In the illustrated embodiment, the boost circuit uses a boost chopper circuit including an inductor 6, a MOS transistor 7 as a switching element, a current detection resistor 8, a diode 9, and a boost capacitor 10. The specific structure of the boost circuit 4 is not limited to the illustrated structure, and various structures can be used. A boost control unit 20, which is described later, switches and controls the MOS transistor 7 in the boost circuit 4 to rectify the energy stored in the inductor 6 using the diode 9, and stores the rectified energy in the boost capacitor 10.

The drive circuit 5 includes a peak current drive switch 11, a battery voltage drive switch 12, low-side drive switches 13*a* and 13*b*, current detection resistors 14*a* and 14*b*, and the like, which are connected as illustrated. Further, the drive circuit 5 includes, as other peripheral circuit elements, a diode 15, a freewheeling diode 16, regenerative diodes 17*a* and 17*b*, a parasitic diode 18, bootstrap circuits 19*a* and 19*b* and the like, which are connected as illustrated. The peak current drive switch 11 functions as an upstream switch configured to switch a connection from a boost voltage Vboost (for example, 65V) to the fuel injection valves 2*a* and 2*b* for performing peak current drive. The battery voltage drive switch 12 functions as an upstream switch for performing constant current drive with a battery voltage VB (for example, 12 V). The low-side drive switches 13*a* and 13*b* function as downstream switches for cylinder selection. The current detection resistors 14*a* and 14*b* are provided for current detection, and may be set to, for example, about 0.030.

The control IC 3 includes the boost control unit 20, a current monitor unit 21, and an energization control unit 22. The boost control unit 20 detects the voltage between the anode and ground of the boost capacitor 10 and also detects the current flowing through the current detection resistor 8. In addition, the boost control unit 20 controls the MOS transistor 7 to turn on and off to control the boost operation of the boost circuit 4. Here, the boost control unit 20 is a functional block. When the boost voltage Vboost drops to (or falls below) a predetermined boost start voltage Vsta, the boost control unit 20 starts performing boost control. A boost completion voltage Vfu is set so that when the boost voltage Vboost reaches the boost completion voltage Vfu, the boost voltage Vboost exceeds the boost start voltage Vsta. When the boost voltage Vboost reaches the boost completion voltage Vfu, the boost control is terminated. During normal operation, the boost control unit 20 controls the boost voltage Vboost to approach the boost completion voltage Vfu while ensuring that this boost voltage Vboost can be output.

The current monitor unit 21 is provided between the low-side drive switches 13*a* and 13*b* and ground. In particular, the current monitor unit 21 monitors the energization current flowing in the fuel injection valves 2*a*, 2*b* via the current detection resistors 14*a*, 14*b*. Here, the current monitor unit 21 is a functional block, and may be implemented as, for example, comparators and an A/D converter (neither illustrated). The current monitor unit 21 outputs the monitoring result to the energization control unit 22 during the period of monitoring the energization current flowing through the fuel injection valves 2*a* and 2*b*.

The energization control unit 22 is a functional block that controls energization of the energization current in order to open and close the fuel injection valves 2*a* and 2*b*. The energization control unit 22 monitors the voltage between the fuel injection valve 2*a* and the low-side drive switch 13*a* as the voltage of the output terminal 1*b*, and monitors the voltage between the fuel injection valve 2*b* and the low-side drive switch 13*b* is the voltage of the output terminal 1*c*. By inputting the monitoring result from the current monitor unit 21, the energization control unit 22 detects the energization current flowing through the fuel injection valves 2*a* and 2*b*, and controls the on/off state of the peak current drive switch 11, the battery voltage drive switch 12, and the low side drive switches 13*a* and 13*b*.

The peak current drive switch 11, the battery voltage drive switch 12, and the low-side drive switches 13*a* and 13*b* may be, for example, n-channel type MOS transistors. The peak current drive switch 11, the battery voltage drive switch 12, and the low-side drive switches 13*a* and 13*b* may also be other types of transistors instead (for example, bipolar transistors), but in the present embodiment, an exemplary configuration in which n-channel type MOS transistors are used will be described. In the following description, the drain, source, and gate of the peak current drive switch 11 refer to the drain, source, and gate of the MOS transistor constituting the peak current drive switch 11, respectively. Similarly, the drain, source, and gate of the battery voltage drive switch 12 refer to the drain, source, and gate of the MOS transistor constituting the battery voltage drive switch 12, respectively. Similarly, the drain, source, and gate of the low-side drive switches 13*a* and 13*b* mean the drain, source, and gate of the MOS transistors constituting the low-side drive switches 13*a* and 13*b*, respectively.

The boost voltage Vboost is supplied from the boost circuit 4 to the drain of the peak current drive switch 11. The source of the peak current drive switch 11 is connected to the output terminal 1*a* on the upstream side. The gate of the peak current drive switch 11 is connected to the energization control unit 22 of the control IC 3, and a control signal is input from the energization control unit 22. The peak current drive switch 11 can energize the output terminal 1*a* with the boost voltage Vboost in response to an input of a control signal from the energization control unit 22.

The battery voltage VB is supplied to the drain of the battery voltage drive switch 12. The source of the battery voltage drive switch 12 is connected to the output terminal 1*a* on the upstream side via the diode 15 in the forward direction. The gate of the battery voltage drive switch 12 is connected to the energization control unit 22 of the control IC 3, and a control signal is input from the energization control unit 22. A parasitic diode 18 is connected between the drain and the source of the battery voltage drive switch 12. The battery voltage drive switch 12 can energize the output terminal 1*a* with the battery voltage VB in response to the input of the control signal from the energization control unit 22.

The diode 15 is connected to prevent backflow from the output node of the boost voltage Vboost to the output node of the battery voltage VB. A freewheeling diode 16 is connected in the opposite direction between the output terminal 1*a* on the upstream side and the ground. The freewheeling diode 16 is connected to a path that recirculates the energizing current flowing through the fuel injection valves 2*a* and 2*b* when the energization current to the fuel injection valves 2*a* and 2*b* is stopped.

The bootstrap circuit 19*a* is connected to the source of the peak current drive switch 11 from the energization control unit 22 of the control IC3. The peak current drive switch 11 is switched and controlled by the potential boosted by the bootstrap action of the bootstrap circuit 19*a*. The bootstrap circuit 19*b* is connected to the source of the battery voltage drive switch 12. The battery voltage drive switch 12 is switched and controlled by the potential boosted by the bootstrap action of the bootstrap circuit 19*b*.

The drains of the low-side drive switches 13*a* and 13*b* are connected to the output terminals 1*b* and 1*c* on the downstream side, respectively. The sources of the low-side drive switches 13*a* and 13*b* are connected to the ground through the current detection resistors 14*a* and 14*b*, respectively. The gates of the low-side drive switches 13*a* and 13*b* are connected to the energization control unit 22 of the control IC 3, and control signals are input from the energization control unit 22. The low-side drive switches 13*a* and 13*b* are capable of selectively energizing the fuel injection valves 2*a* and 2*b* in response to input of a control signal from the energization control unit 22.

The regenerative diodes 17*a* and 17*b* are connected to the energization path of the regenerative current that flows when the fuel injection valves 2*a* and 2*b* are closed, respectively, and regenerate the current toward the boost capacitor 10.

Next, the operation of the above configuration will be described with reference to FIGS. 2 and 3.

When the energization command TQ is turned on according to an energization current profile stored in advance, the control IC 3 turns on the peak current drive switch 11 and the low side drive switches 13*a* and 13*b* to start the peak current drive (t1). When the control IC 3 starts the peak current drive, the peak current starts to flow through the fuel injection valves 2*a*, 2*b*, and the energizing current to the fuel injection valves 2*a*, 2*b* increases. When the energy supplied to the fuel injection valves 2*a*, 2*b* reaches a first predetermined amount, the needle lift amount at the fuel injection valves 2*a*, 2*b* begins to increase (t2).

Next, the control IC 3 turns off the peak current drive switch 11 after a predetermined amount of time lapses since turning on the peak current drive switch 11, and ends the peak current drive (t3). When the control IC 3 finishes the peak current drive, the energization current to the fuel injection valves 2*a*, 2*b* decreases, and an intermediate flyback current begins to flow through the injection valves 2*a*, 2*b*, This intermediate flyback current continues to flow until the constant current switching control of the battery voltage drive switch 12 begins. Further, when the energy supplied to the fuel injection valves 2*a*, 2*b* reaches a second predetermined amount, the fuel injection valves 2*a*, 2*b* open.

Next, the control IC 3 starts switching the battery voltage drive switch 12 on and off to begin the constant current drive. That is, the control IC 3 starts the constant current switching control of the battery voltage drive switch 12 (t4). When the control IC 3 starts the constant current switching control of the battery voltage drive switch 12, a holding current flows through the fuel injection valves 2*a*, 2*b*. The holding current is switched between an upper limit threshold value and a lower limit threshold value of the fuel injection valves 2*a*, 2*b*.

Next, the control IC 3 turns off the energization command TQ according to the energization current profile. At this time, if the current value of the holding current flowing through the fuel injection valves 2*a*, 2*b* is not equal to the upper limit threshold value, the switching of the batten voltage drive switch 12 is continued. In other words, the constant current switching control of the battery voltage drive switch 12 is continued without being terminated (t5). Instead, the control IC 3 waits for the current value of the holding current to reach the upper limit threshold value for the first time after turning off the energization command TQ. When the current value of the holding current reaches the upper limit threshold value for the first time after having turned off the energization instruction TQ, the control IC 3 then stops switching the battery voltage drive switch 12, and at the same time turns off the low-side drive switches 13*a*, 13*b*. At this time, the constant current switching control with the battery voltage drive switch 12 is terminated (t6). In the example of FIG. 2, the time from "t5" to "t6" corresponds to an off delay control period, starting from the off timing of the energization instruction TQ and ending at the end timing of the constant current switching control of the battery voltage drive switch 12.

When the control IC 3 finishes the constant current switching control of the battery voltage drive switch 12, the holding current starts to decrease from the upper limit threshold value. At this time, a voltage on the downstream side of the fuel injection valves 2*a*, 2*b* is generated, and a flyback current starts to flow in the fuel injection valves 2*a*, 2*b*. The voltage downstream of the fuel injection valves 2*a*, 2*b* is a constant value while the flyback current is flowing (i.e., while the flyback current value is not equal to zero). When the flyback current stops flowing (i.e., when the flyback current value reaches zero), the voltage downstream of the fuel injection valves 2*a*, 2*b* begins to decrease from that constant value (t7). Here, the period during which the flyback current is flowing is referred to as a flyback period. As shown in the example of FIG. 2, the flyback period is between time t6 and time t7 (corresponding to a first predetermined time period).

After that, when the voltage on the downstream side of the fuel injection valves 2*a*, 2*b* begins to decrease, the needle lift amount of the fuel injection valves 2*a*, 2*b* also begins to decrease. When the fuel injection valves 2*a*, 2*b* is closed, the needle lift position reaches the seated position. When this happens, an electromotive force is generated due to a change in magnetic flux, and an inflection point is generated in the voltage on the downstream side of the fuel injection valves 2*a*, 2*b* (t8).

In the above configuration, when the energization command TQ is turned off according to the energization current profile, if the current value of the holding current is not equal to the upper limit threshold value, the switching of the battery voltage drive switch 12 is continued. In other words, the constant current switching control of the battery voltage drive switch 12 is continued without being terminated. Then, when the current value of the holding current reaches the upper limit threshold value for the first time after having turned off the energization instruction TQ, the switching of the battery voltage drive switch 12 is stopped, and the constant current switching control of the battery voltage drive switch 12 is terminated. In other words, even though the ripple current during the constant current switching control may have a fluctuating period due to fluctuations in battery voltage, temperature characteristics of the solenoid coil of the fuel injection valve, etc., the termination timing for ending the constant current switching control of the battery voltage drive switch 12 is controlled to always be when the current value of the holding current reaches the upper limit threshold value for the first time after having turned off the energization instruction TQ. Due to this, the flyback period is constant. As a result, the valve closing timing of the fuel injection valves 2*a*, 2*b* can be made constant, and the injection amount accuracy can be improved.

These technical effects will be described with reference to FIG. 3 as a comparative example. As described above, the period of the ripple current during constant current switching control may fluctuate due to fluctuations in the battery voltage, temperature characteristics of the solenoid coil of the fuel injection valve, etc. As a result, if the constant current switching control of the battery voltage drive switch 12 is turned off at the same time that the energization command TQ is turned off, the current value of the holding current at the start of flyback is not constant. That is, in the comparative example of FIG. 3, the flyback period is between time t11 and time t12 for the energizing current of waveform A, whereas the flyback period is between time t11 and time t13 for the energizing current of waveform B. In other words, these flyback periods are different in length of time as each other. In this case, the flyback period is not constant and may vary. Therefore, the valve closing timing of the fuel injection valves 2*a*, 2*b* is also not constant, and injection amount accuracy is reduced.

To solve such a problem, it is possible to reduce the variations in the flyback time by reducing the ripple amplitude during the constant current switching control. However, in the configuration where the ripple amplitude is reduced during constant current switching control, the number of times that the switching element are switched increases and the amount of heat generated due to switching loss increases. As a result, there is a concern that the physical size of the overall device may need to be increased for the purpose of heat dissipation measures.

In contrast, in the present embodiment, the termination timing for ending the constant current switching control of the battery voltage drive switch 12 is controlled to always be when the current value of the holding current reaches the upper limit threshold value for the first time after having turned off the energization instruction TQ. Due to this, the flyback period is always constant, and injection amount accuracy may be improved.

According to the first embodiment, the following effects can be exhibited. When the energization of the holding current to the fuel injection valves 2*a*, 2*b* is to be stopped, the injection control device 1 is configured to control the energization stop timing of the holding current such that the flyback period is equal to the first predetermined time period. By always keeping the flyback period constant, the valve closing timing of the fuel injection valves 2*a*, 2*b* can be made to always be constant, and the injection amount accuracy can be improved. In this case, only the control logic is improved, so it is not necessary to reduce the ripple amplitude during constant current switching control, and the amount of heat generated due to the switching loss does not increase. As a result, it is possible to appropriately improve the injection amount accuracy while eliminating the increase in size and cost of the device.

Further, using the upper limit threshold value of the constant current switching control of the battery voltage drive switch 12, the off timing of the battery voltage drive switch 12 is controlled such that the current value of the holding current at the start of flyback reaches the upper limit threshold of the constant current switching control. By using the upper limit threshold value of the constant current switching control without preparing a new threshold value, the valve closing timing of the fuel injection valves 2*a*, 2*b* can be always constant, and injection amount accuracy can be improved.

Second Embodiment

Figure 4:
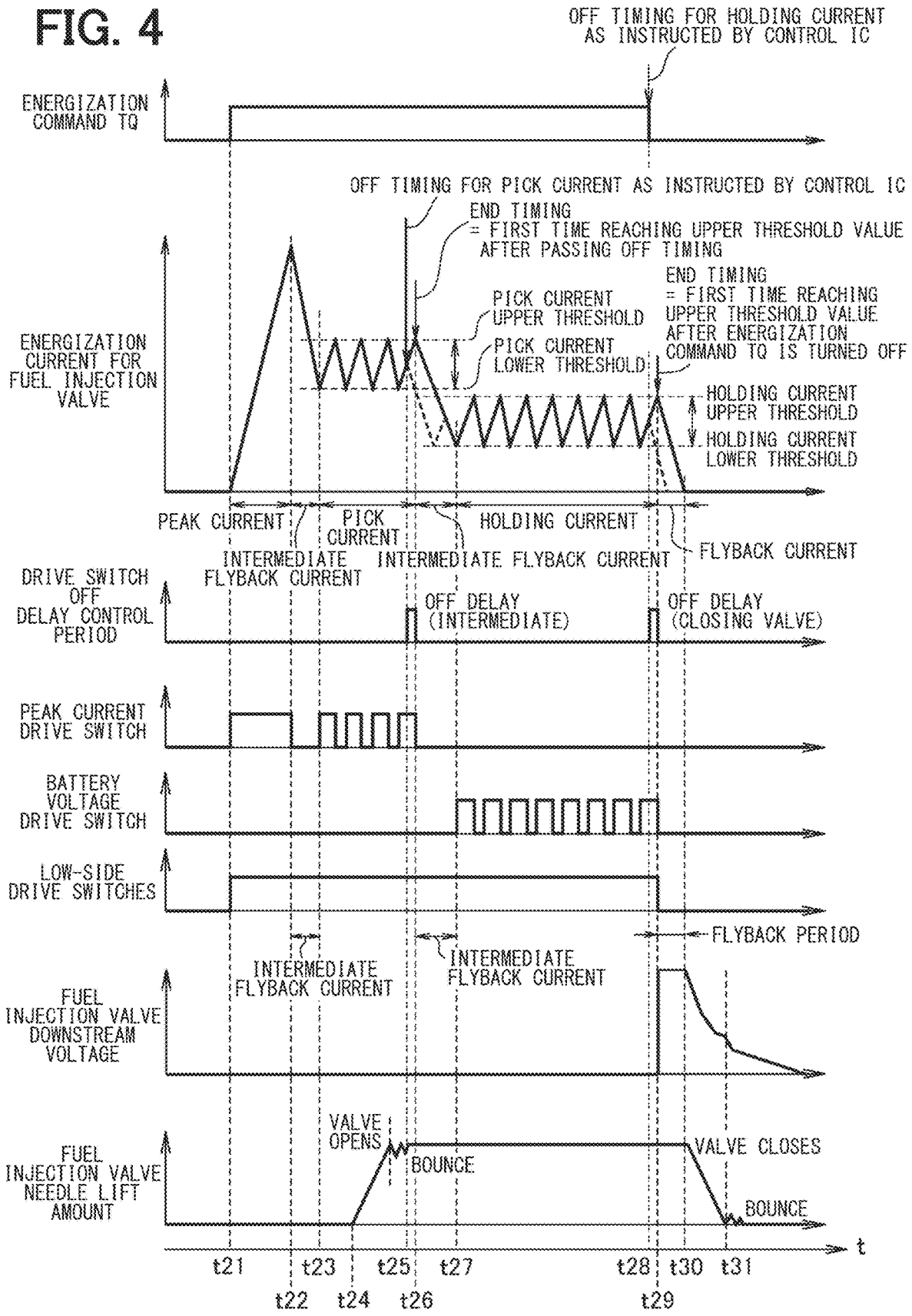
FIG. 4 is a timing chart.

The second embodiment will be described with reference to FIG. 4. The second embodiment is different from the above-described first embodiment in that, when transitioning from peak current drive to holding current drive, the energization stop timing of a pick current is controlled such that the intermediate flyback period is a constant amount of time.

When the energization command TQ is turned on according to the energization current profile, the control IC 3 turns on the peak current drive switch 11 and the low side drive switches 13*a* and 13*b* to start the peak current drive (t21).

Next, the control IC 3 turns off the peak current drive switch 11 after a lapse of a predetermined time since having turned on the peak current drive switch 11 (t22). Then, the control IC 3 begins switching the peak current drive switch 11 on and off to start constant current switching control of the peak current drive switch 11 (t23). When the control IC 3 starts constant current switching control of the peak current drive switch 11, a pick current begins to flow in the fuel injection valves 2*a*, 2*b*. The pick current is switched between an upper limit threshold value and a lower limit threshold value of the fuel injection valves 2*a*, 2*b*. Here, the pick current is distinct from the previous described holding current. The current to pull the plunger of the solenoid is referred to as a "pick" current and the current to hold the plunger in an open position is referred to as a "holding" current. The pick current is greater than the holding current, and so their respective upper limit threshold values and lower limit threshold values are different as well, as shown in FIG. 4, When the energy supplied to the fuel injection valve 2*a*, 2*b* reaches the first predetermined amount, the needle lift amount starts to increase (t24). Then, when the energy supplied to the fuel injection valves 2*a*, 2*b* reaches a second predetermined amount, the fuel injection valves 2*a*, 2*b* open.

Next, the off timing for the pick current is reached based on the predetermined energization current profile of the control IC 3 (t25). At this time, if the current value of the pick current flowing through the fuel injection valves 2*a*, 2*b* is not equal to the upper limit threshold value, the switching of the peak current drive switch 11 is continued. In other words, the constant current switching control of the peak current drive switch 11 is continued without being terminated. Instead, the control IC 3 waits for the current value of the pick current to reach the upper limit threshold value for the first time after having passed the off timing of the pick current. Then, when the current value of the pick current reaches the upper limit threshold value for the first time after having passed the off timing of the pick current, the switching of the peak current drive switch 11 is stopped by the control IC 3, and the constant current switching control of the peak current drive switch 11 is terminated (t26). In the example of FIG. 4, the period between time t25 and time t26 corresponds to an off delay control period, starting from the off timing of the pick current and ending at the end timing of the constant current switching control of the peak current drive switch 11.

When the control IC 3 finishes the constant current switching control of the peak current drive switch 11, the pick current starts to decrease from the upper limit threshold value. At this time, an intermediate flyback current starts to flow in the fuel injection valves 2*a*, 2*b*.

Next, the control IC 3 starts switching the battery voltage drive switch 12 on and off. That is, the control IC 3 starts the constant current switching control of the battery voltage drive switch 12 (t27). When the control IC 3 starts the constant current switching control of the battery voltage drive switch 12, the intermediate flyback current stops flowing, and the holding current flows through the fuel injection valves 2*a*, 2*b*. The holding current is switched between the upper limit threshold value and the lower limit threshold value of the fuel injection valves 2*a*, 2*b*. Here, the period during which the intermediate flyback current is flowing is referred to as an intermediate flyback period. As shown in the example of FIG. 4, the intermediate flyback period is between time t26 and time t27 (corresponding to a second predetermined time period). After that, the control IC 3 performs the same controls as that of the first embodiment described above (t28 to t31).

In the above configuration, upon reaching the off timing of the pick current according to the energization current profile, if the current value of the pick current is not equal to the upper limit threshold value, the switching of the peak current drive switch 11 is continued. In other words, the constant current switching control of the peak current drive switch 11 is continued without being terminated. Then, when the current value of the pick current reaches the upper limit threshold value for the first time after having passed the off timing of the pick current, the switching of the peak current drive switch 11 is stopped, and the constant current switching control of the peak current drive switch 11 is terminated. That is, since the energy input to the fuel injection valves 2*a*, 2*b* includes the intermediate flyback current, by controlling the end timing of the constant current switching control of the peak current drive switch 11 to be when the current value of the pick current reaches the upper limit threshold value for the first time after having passed the off timing of the pick current, the intermediate flyback period can be made to be constant. As a result, in addition to ensuring that the closing timing of the fuel injection valves 2*a*, 2*b* is constant, the opening timing of the fuel injection valves 2*a*, 2*b* can also be made to be constant, and injection amount accuracy can be improved.

According to the second embodiment, the following effects can be exhibited. In the injection control device 1, when the holding current to the fuel injection valves 2*a*, 2*b* is to be stopped, the holding current energization stop timing is controlled so that the flyback period is equal to the first predetermined time period. In addition, prior to that, when the pick current to the fuel injection valves 2*a*, 2*b* is to be stopped, the pick current energization stop timing is controlled so that the intermediate flyback period is equal to the second predetermined time period. As a result, in addition to ensuring that the closing timing of the fuel injection valves 2*a*, 2*b* is always constant by keeping the flyback period constant, the opening timing of the fuel injection valves 2*a*, 2*b* can also be made to be always constant by keeping the intermediate flyback period constant, and injection amount accuracy can be improved.

Third Embodiment

Figure 5:
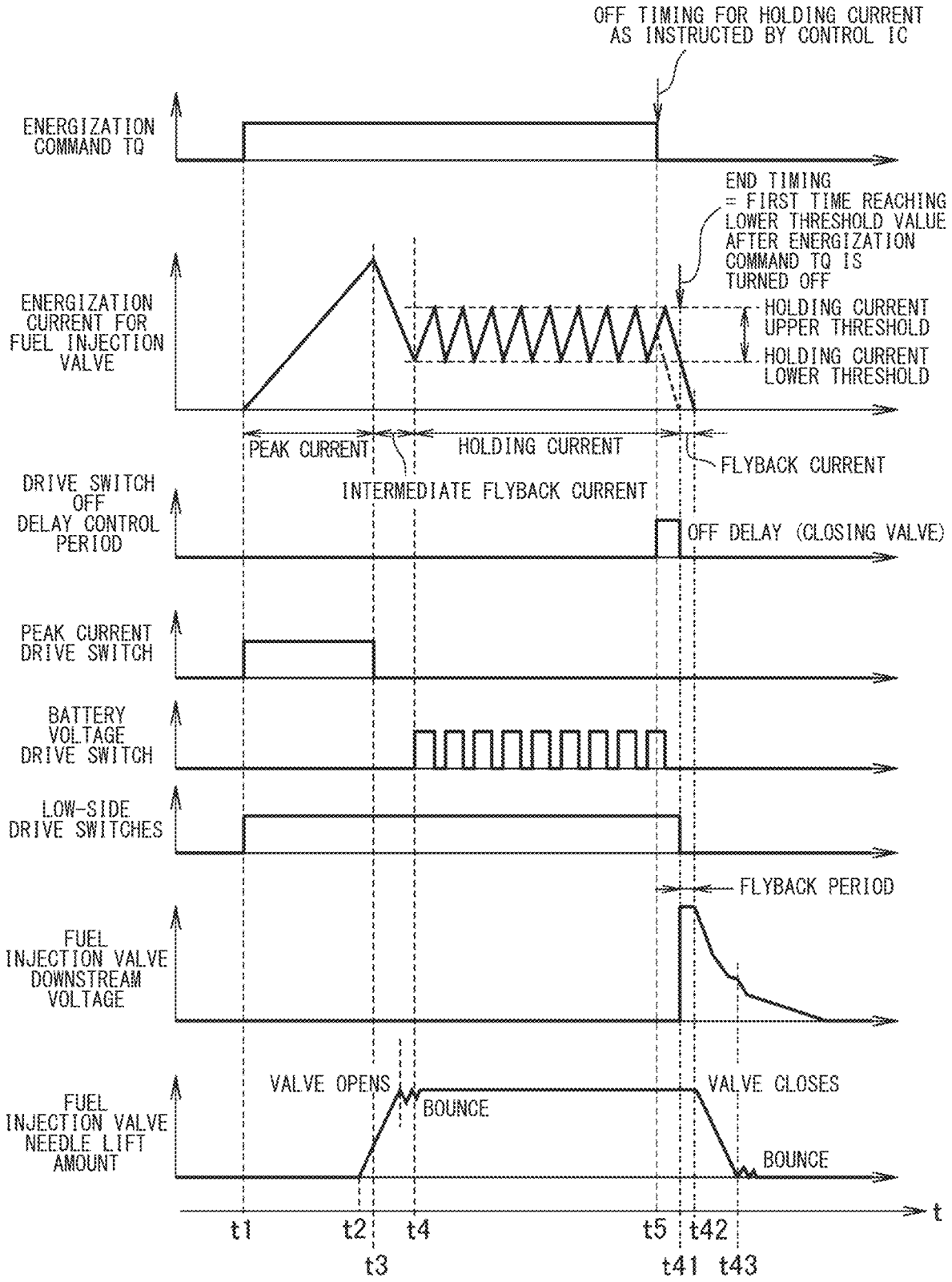
FIG. 5 is a timing chart.

The third embodiment will be described with reference to FIG. 5. The third embodiment is different from the first embodiment in that the lower limit threshold value of the constant current switching control of the battery voltage drive switch 12 is used. Specifically, when the current value of the holding current reaches the lower limit threshold value for the first time after having turned off the energization instruction TQ, the switching of the battery voltage drive switch 12 stopped, and the constant current switching control with the battery voltage drive switch 12 is terminated.

The control IC 3 turns off the energization command TQ according to the energization current profile. At this time, if the current value of the holding current flowing through the fuel injection valves 2*a*, 2*b* is not equal to the lower limit threshold value, the switching of the battery voltage drive switch 12 is continued. In other words, the constant current switching control of the battery voltage drive switch 12 is continued without being terminated (t5). Instead, the control IC 3 waits for the current value of the holding current to reach the lower limit threshold value for the first time after turning off the energization command TQ. When the current value of the holding current reaches the lower limit threshold value for the first time after having turned off the energization instruction TQ, the control IC 3 then stops switching the battery voltage drive switch 12, and at the same time turns off the low-side drive switches 13*a*, 13*b*. At this time, the constant current switching control with the battery voltage drive switch 12 is terminated (t41). In the example of FIG. 5, the off delay control period is between time t5 and time t41, and the flyback period (corresponding to the first predetermined time period) is between time t41 and time t42.

According to the third embodiment, using the lower limit threshold value of the constant current switching control of the battery voltage drive switch 12, the off timing of the battery voltage drive switch 12 is controlled such that the current value of the holding current at the start of flyback reaches the lower limit threshold of the constant current switching control. Similar to the first embodiment, by using the lower limit threshold value of the constant current switching control, the valve closing timing of the fuel injection valves 2*a*, 2*b* can be always constant, and injection amount accuracy can be improved.

Fourth Embodiment

The fourth embodiment will be described with reference to FIGS. 6 and 7. The fourth embodiment is different from the first embodiment in that the center value between the upper limit threshold value and the lower limit threshold value of the constant current switching control of the battery voltage drive switch 12 is used. Specifically, when the current value of the holding current reaches the center value for the first time after having turned off the energization instruction TQ, the switching of the battery voltage drive switch 12 stopped, and the constant current switching control with the battery voltage drive switch 12 is terminated.

The control IC 3 turns off the energization command TQ according to the energization current profile. At this time, if the current value of the holding current flowing through the fuel injection valves 2*a*, 2*b* is not equal to the center value, the switching of the battery voltage drive switch 12 is continued. In other words, the constant current switching control of the battery voltage drive switch 12 is continued without being terminated (t5). Instead, the control IC 3 waits for the current value of the holding current to reach the center value for the first time after turning off the energization command TQ. When the current value of the holding current reaches the center value for the first time after having turned off the energization instruction TQ, the control IC 3 then stops switching the battery voltage drive switch 12, and at the same time turns off the low-side drive switches 13*a*, 13*b*. At this time, the constant current switching control with the battery voltage drive switch 12 is terminated (t51, t61).

Figure 6:
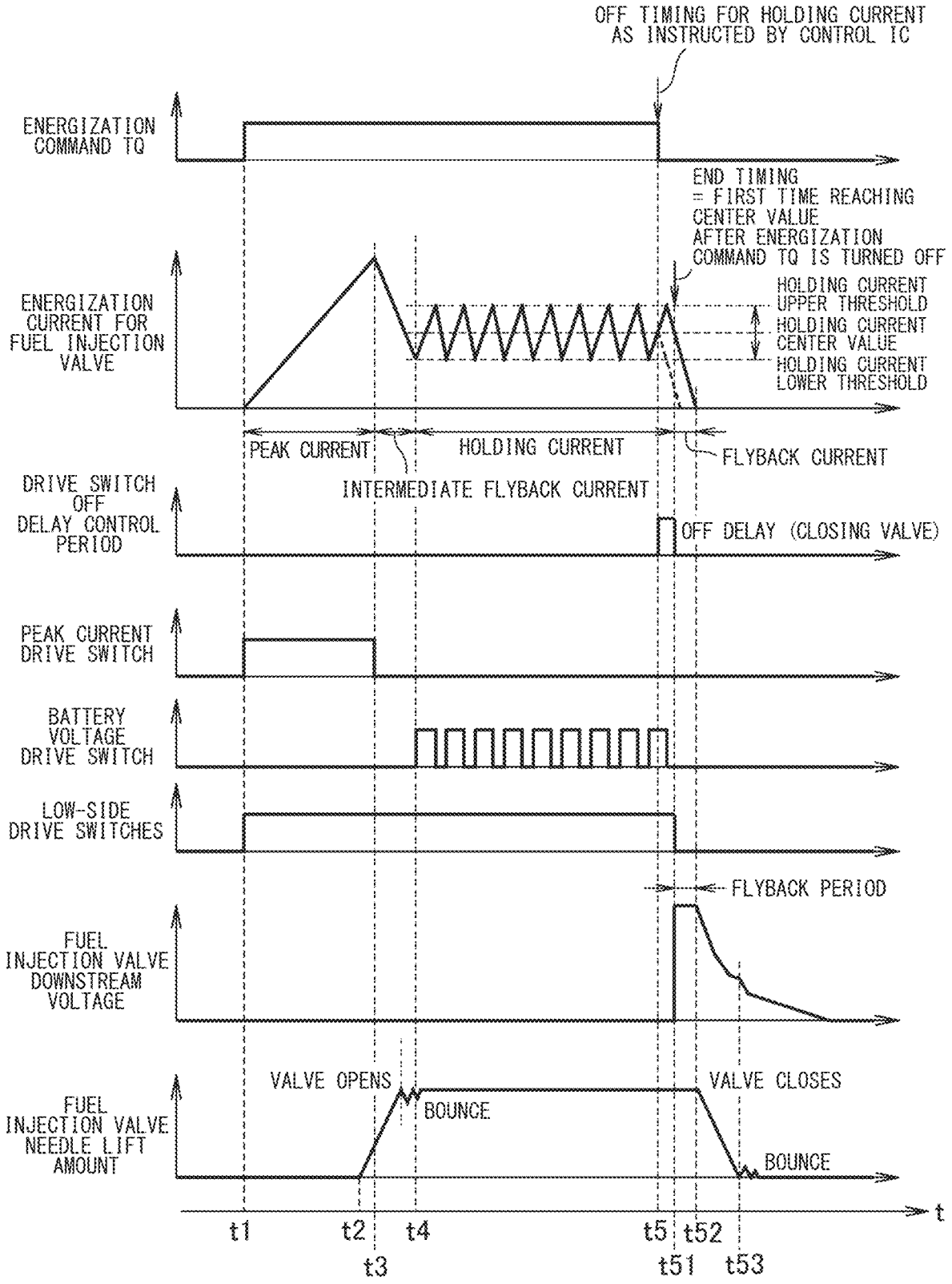
FIG. 6 is a timing chart.
Figure 7:
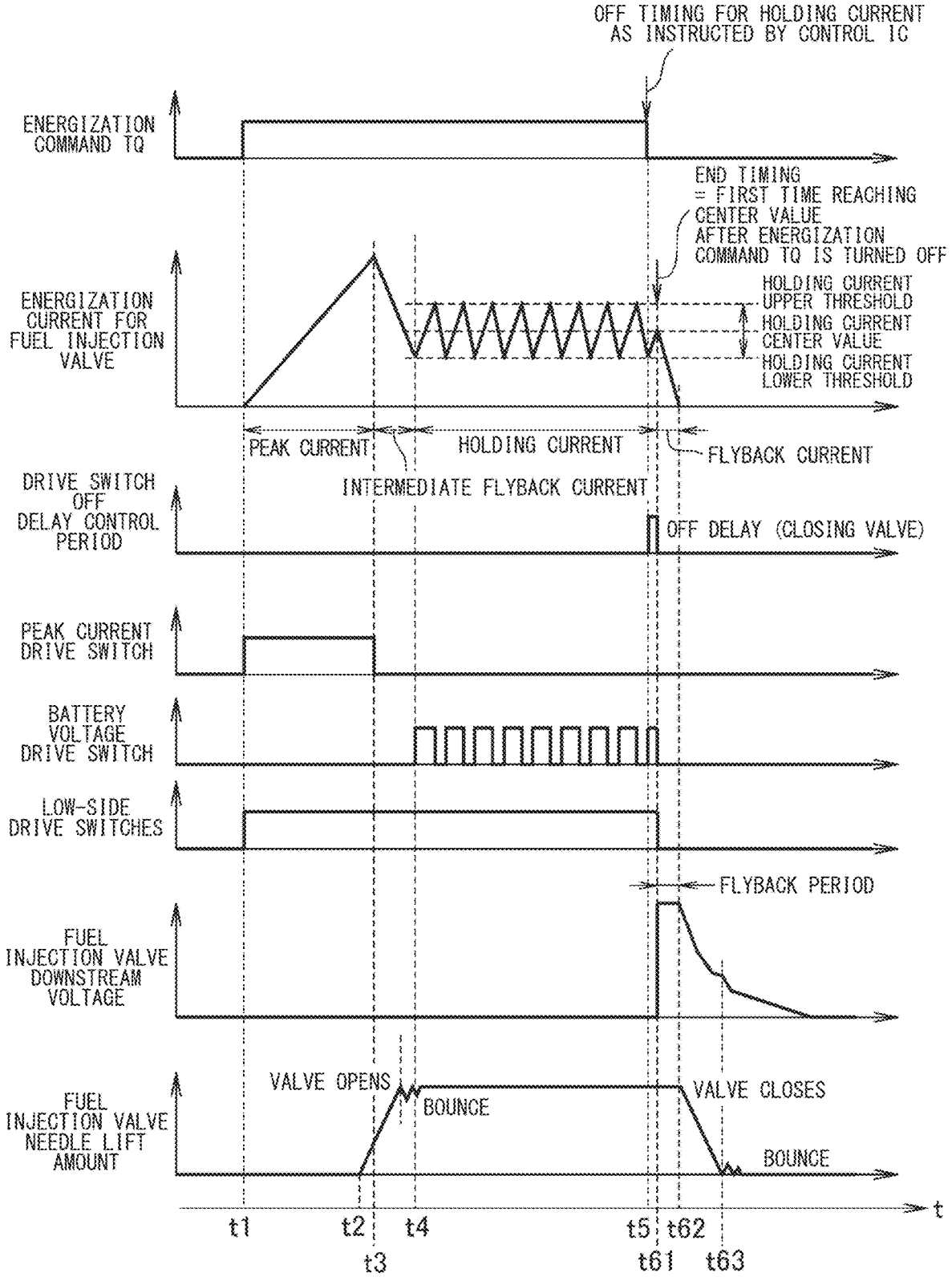
FIG. 7 is a timing chart.

That is, the control IC 3 terminates the constant current switching control of the battery voltage drive switch 12 when the current value of the holding current reaches the center value from the upper limit threshold value as shown in FIG. 6, or when the current value of the holding current reaches the center value from the lower limit threshold value as shown in FIG. 7. In the example of FIG. 6, the off delay control period is between time t5 and time t51, and the flyback period (corresponding to the first predetermined time period) is between time t51 and time t52. In the example of FIG. 7, the off delay control period is between time t5 and time t61, and the flyback period (corresponding to the first predetermined time period) is between time t61 and time t62.

According to the fourth embodiment, using the center value between the upper limit threshold value and the lower limit threshold value of the constant current switching control of the battery voltage drive switch 12, the off timing of the battery voltage drive switch 12 is controlled such that the current value of the holding current at the start of flyback reaches the center value of the constant current switching control. Similar to the first embodiment, by using the center value of the constant current switching control, the valve closing timing of the fuel injection valves 2*a*, 2*b* can be always constant, and injection amount accuracy can be improved. Further, by using the center value of the constant current switching control, the flyback period can be shortened as compared with the configurations using the upper limit threshold value described in the first embodiment and the lower limit threshold value described in the third embodiment. As a result, variations in the flyback period can be further reduced.

Fifth Embodiment

A fifth embodiment will be described with reference to FIGS. 8 and 9. The fifth embodiment is different from the first embodiment in that an effective value of the constant current switching control of the battery voltage drive switch 12 is used. Specifically, when the current value of the holding current reaches the effective value for the first time after having turned off the energization instruction TQ, the switching of the battery voltage drive switch 12 stopped, and the constant current switching control with the battery voltage drive switch 12 is terminated. The control IC 3 approximates the waveform of the constant current switching control to a triangular wave, and calculates the effective value by the following formula.

Effective value=lower limit threshold+(upper limit threshold−lower limit threshold)/√3

The control IC 3 turns off the energization command TO according to the energization current profile. At this time, if the current value of the holding current flowing through the fuel injection valves 2*a*, 2*b* is not equal to the effective value, the switching of the battery voltage drive switch 12 is continued. In other words, the constant current switching control of the battery voltage drive switch 12 is continued without being terminated (t5). Instead, the control IC 3 waits for the current value of the holding current to reach the effective value for the first time after turning off the energization command TQ. When the current value of the holding current reaches the effective value for the first time after having turned off the energization instruction TQ, the control IC 3 then stops switching the battery voltage drive switch 12, and at the same time turns off the low-side drive switches 13*a*, 13*b*. At this time, the constant current switching control with the battery voltage drive switch 12 is terminated (t71, t81).

Figure 8:
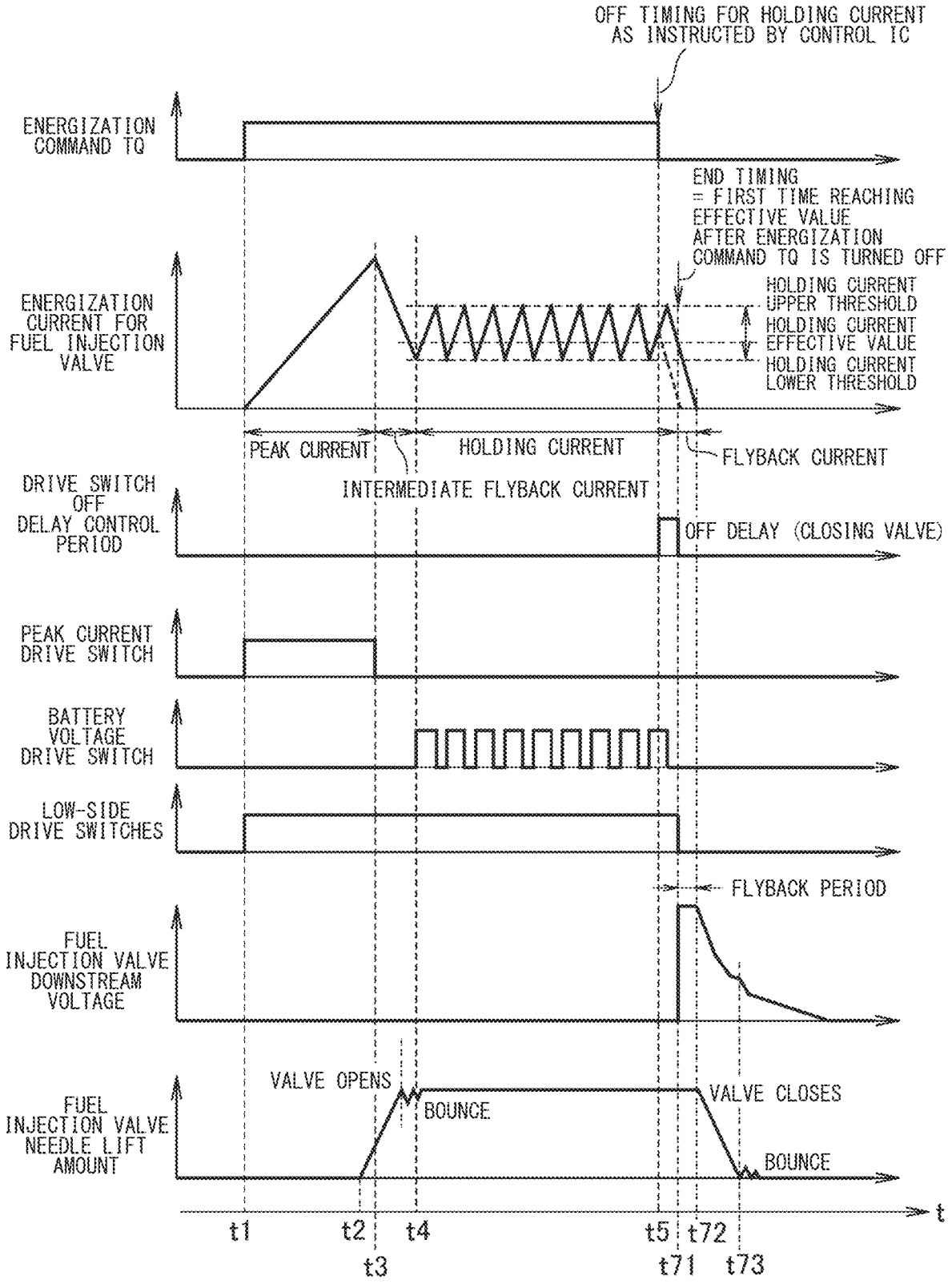
FIG. 8 is a timing chart.
Figure 9:
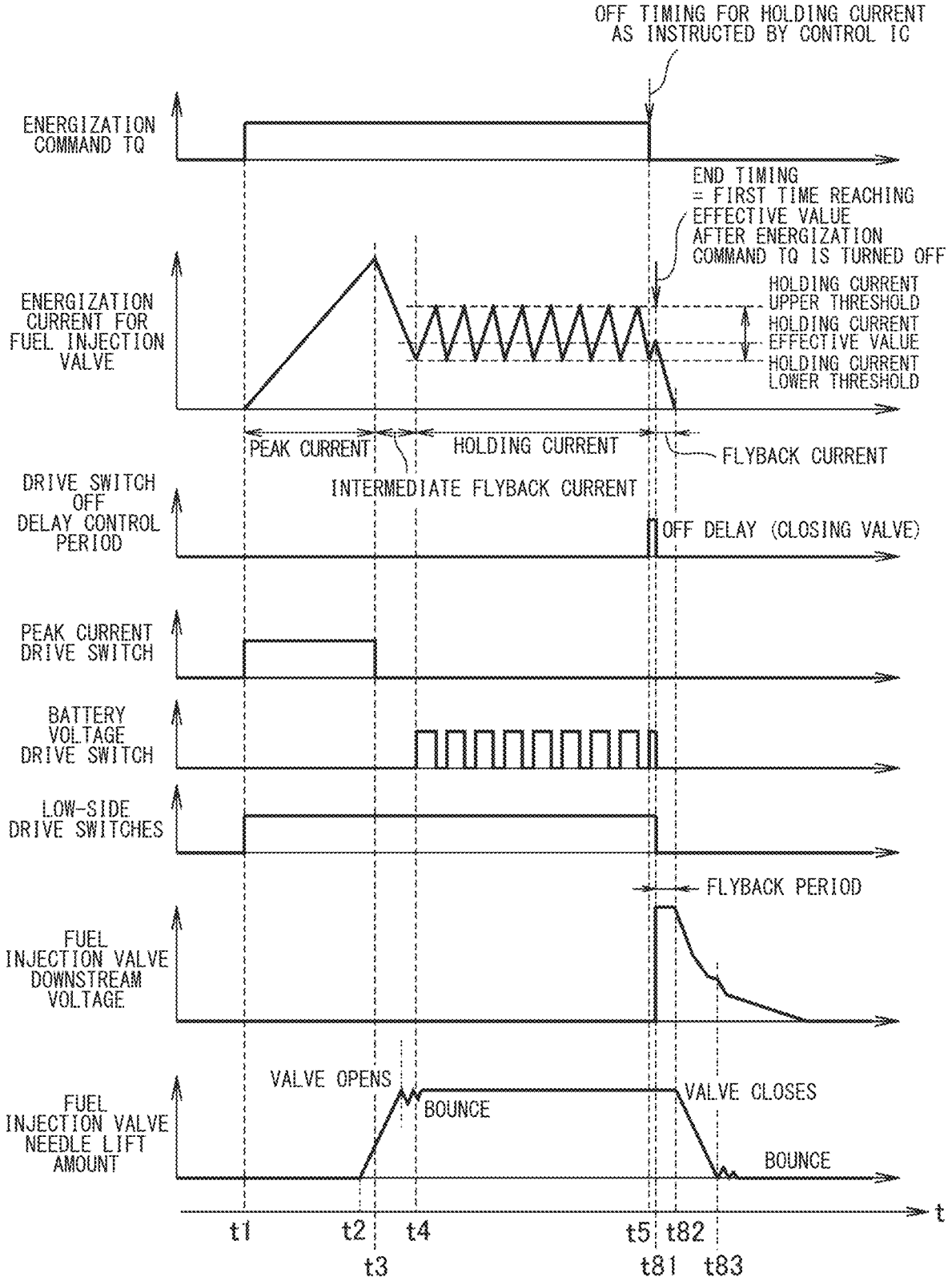
FIG. 9 is a timing chart.

That is, the control IC 3 terminates the constant current switching control of the battery voltage drive switch 12 when the current value of the holding current reaches the effective value from the upper limit threshold value as shown in FIG. 8, or when the current value of the holding current reaches the effective value from the lower limit threshold value as shown in FIG. 9. In the example of FIG. 8, the off delay control period is between time t5 and time t71, and the flyback period (corresponding to the first predetermined time period) is between time t71 and time t72. In the example of FIG. 9, the off delay control period is between time t5 and time t81, and the flyback period (corresponding to the first predetermined time period) is between time t81 and time t82.

According to the fifth embodiment, using the effective value of the constant current switching control of the battery voltage drive switch 12, the off timing of the battery voltage drive switch 12 is controlled such that the current value of the holding current at the start of flyback reaches the effective value of the constant current switching control. Similar to the first embodiment, by using the effective value of the constant current switching control, the valve closing timing of the fuel injection valves 2*a*, 2*b* can be always constant, and injection amount accuracy can be improved. Further, by using the effective value of the constant current switching control, in this case as well, the flyback period can be shortened as compared with the configurations using the upper limit threshold value described in the first embodiment and the lower limit threshold value described in the third embodiment. As a result, variations in the flyback period can be further reduced.

Other Embodiments

Although the present disclosure has been described in accordance with the examples, it is understood that the present disclosure is not limited to such examples or structures. The present disclosure encompasses various modifications and variations within the scope of equivalents. Additionally, various combinations and configurations, as well as other combinations and configurations including more, less, or only a single element, are within the scope and spirit of the present disclosure.

In the second embodiment, an exemplary embodiment is described in which the constant current switching control of the peak current drive switch 11 is terminated when the current value of the pick current reaches the upper limit threshold value for the first time after passing the off timing of the pick current. Instead of the upper limit threshold value, the lower limit threshold value, the center value between the upper limit threshold value and the lower limit threshold value, or an effective value may be used instead. That is, the constant current switching control of the peak current drive switch 11 may be terminated when the current value of the pick current reaches the lower limit threshold value, the center value, or the effective value for the first time after passing the off timing of the pick current.

The configuration for controlling the energization stop timing of the pick current described in the second embodiment may be applied to the third to fifth embodiments.

The invention claimed is:

1. An injection control device that controls the opening and closing of a fuel injection valve by performing a peak current drive and a constant current drive with respect to the fuel injection valve and controls injection of fuel from the fuel injection valve to an internal combustion engine, comprising an energization control unit that performs constant current switching control of an energization current to the fuel injection valve, wherein:

the energization control unit is configured to, when the energization current to the fuel injection valve is to be stopped, control an energization stop timing of the energization current such that a flyback period is equal to a first predetermined time period, the constant current switching control includes a pick current drive using a boost voltage and a holding current drive using a battery power source, and the energization control unit is configured to:

when transitioning from the pick current drive to the holding current drive, control an energization stop timing of a pick current such that an intermediate flyback period is equal to a second predetermined time period, and when the energization current to the fuel injection valve is to be stopped, control an energization stop timing of a holding current such that the flyback period is equal to the first predetermined time period.

2. The injection control device of claim 1, wherein the energization control unit controls the energization stop timing of the energization current such that the flyback period is equal to the first predetermined time period by controlling an off timing of a drive switch such that a current value of the energization current is equal to a predetermined value when flyback begins.

3. The injection control device of claim 2, wherein the energization control unit uses a lower limit threshold value of the constant current switching control as the predetermined value.

4. The injection control device of claim 2, wherein the energization control unit uses an effective value of the constant current switching control as the predetermined value.

5. The injection control device of claim 1, wherein the energization control unit controls the energization stop timing of the pick current such that the intermediate flyback period is equal to the second predetermined time period by controlling an off timing of a drive switch such that a current value of the pick current is equal to a predetermined value when intermediate flyback begins.

6. An injection control device that controls the opening and closing of a fuel injection valve by performing a peak current drive and a constant current drive with respect to the fuel injection valve and controls injection of fuel from the fuel injection valve to an internal combustion engine, comprising an energization control unit that performs constant current switching control of an energization current to the fuel injection valve, wherein:

the energization control unit is configured to, when the energization current to the fuel injection valve is to be stopped, control an energization stop timing of the energization current such that a flyback period is equal to a first predetermined time period, the energization control unit is further configured to control the energization stop timing of the energization current such that the flyback period is equal to the first predetermined time period by controlling an off timing of a drive switch such that a current value of the energization current is equal to a predetermined value when flyback begins, and the energization control unit is further configured to use an upper limit threshold value of the constant current switching control as the predetermined value.

7. An injection control device that controls the opening and closing of a fuel injection valve by performing a peak current drive and a constant current drive with respect to the fuel injection valve and controls injection of fuel from the fuel injection valve to an internal combustion engine, comprising an energization control unit that performs constant current switching control of an energization current to the fuel injection valve, wherein:

the energization control unit is configured to, when the energization current to the fuel injection valve is to be stopped, control an energization stop timing of the energization current such that a flyback period is equal to a first predetermined time period, the energization control unit is further configured to control the energization stop timing of the energization current such that the flyback period is equal to the first predetermined time period by controlling an off timing of a drive switch such that a current value of the energization current is equal to a predetermined value when flyback begins, and the energization control unit is further configured to use a center value between an upper limit threshold value and a lower limit threshold value of the constant current switching control as the predetermined value.

8. An injection control system, comprising:

a fuel injection valve configured to inject fuel for an internal combustion engine;

a drive circuit including a drive switch connected to the fuel injection valve, the drive circuit being configured to connect a drive voltage to the fuel injection valve when the drive switch is turned on; and a drive controller including a processor programmed to:

perform a constant current switching control on the drive switch of the drive circuit to apply an energization current to the fuel injection valve to energize the fuel injection valve, and control an energization stop timing of the energization current such that a flyback period is equal to a first predetermined time period, the flyback period being a duration of time during which flyback current flows through the fuel injection valve after the drive switch is turned off, wherein:

the constant current switching control includes a pick current drive using a boost voltage and a holding current drive using a battery power source, and the processor is further programmed to:

when transitioning from the pick current drive to the holding current drive, control an energization stop timing of a pick current such that an intermediate flyback period is equal to a second predetermined time period, and when the energization current to the fuel injection valve is to be stopped, control an energization stop timing of a holding current such that the flyback period is equal to the first predetermined time period.

9. The injection control device of claim 8, wherein the processor is further programmed to control the energization stop timing of the energization current such that the flyback period is equal to the first predetermined time period by controlling an off timing of the drive switch such that a current value of the energization current is equal to a predetermined value when flyback begins.

10. The injection control device of claim 9, wherein the processor uses an upper limit threshold value of the constant current switching control as the predetermined value.

11. The injection control device of claim 9, wherein the processor uses a lower limit threshold value of the constant current switching control as the predetermined value.

12. The injection control device of claim 9, wherein the processor uses a center value between an upper limit threshold value and a lower limit threshold value of the constant current switching control as the predetermined value.

13. The injection control device of claim 9, wherein the processor uses an effective value of the constant current switching control as the predetermined value.

14. The injection control device of claim 8, wherein the processor is further programmed to control the energization stop timing of the pick current such that the intermediate flyback period is equal to the second predetermined time period by controlling an off timing of the drive switch such that a current value of the pick current is equal to a predetermined value when intermediate flyback begins.

* * * * *